US006263647B1

(12) United States Patent
Walkley

(10) Patent No.: US 6,263,647 B1
(45) Date of Patent: Jul. 24, 2001

(54) HORSE SADDLE TREE HAVING FABRIC REINFORCED RUBBER BARS

(75) Inventor: W. J. Walkley, Rainbow City, AL (US)

(73) Assignee: Pro Saddlery, L.L.C., Rainbow City, AL (US)

( * ) Notice: Subject to any disclaimer, the term of this patent is extended or adjusted under 35 U.S.C. 154(b) by 0 days.

(21) Appl. No.: 09/422,901

(22) Filed: Oct. 21, 1999

(51) Int. Cl.[7] ..... B68C 1/02; B68G 1/00
(52) U.S. Cl. ..... 54/44.1; 54/44.7
(58) Field of Search ..... 54/44.1, 44.3, 54/44.5, 44.7, 66; 297/195.1

(56) References Cited

U.S. PATENT DOCUMENTS

| | | | | |
|---|---|---|---|---|
| 213,418 | * | 3/1879 | Herring | 54/44.1 |
| 1,111,817 | * | 9/1914 | Adams | 54/44.7 |
| 2,353,622 | * | 7/1944 | Boyle | 54/44.1 |
| 4,745,734 | * | 5/1988 | Brown | 54/44.1 |
| 5,119,618 | * | 6/1992 | Streck | 54/66 |
| 5,191,752 | * | 3/1993 | Murphy | 54/44.5 |
| 5,383,328 | | 1/1995 | Brown | 54/44.3 |
| 5,953,889 | * | 9/1999 | Jones | 54/44.1 |

* cited by examiner

*Primary Examiner*—Peter M. Poon
*Assistant Examiner*—Elizabeth Shaw
(74) *Attorney, Agent, or Firm*—Kenneth W. Iles

(57) ABSTRACT

A saddle tree for a horse saddle includes a pair of spaced opposed flexible rubber bars having a fork attached to the front of the saddle tree and a cantle attached to the rear of the saddle tree. The fork and cantle are made from wood or the like and are fastened to the rubber bars by screws or the like. The rubber bars are made of rubber having laminated fabric layers, with alternating layers of woven and straight cord fabric, dispersed throughout the rubber. The rubber bars are flexible and conform to the horse's back during any type of movement by the horse, more evenly distributing the weight of the rider and saddle and the forces generated by riding that prior art saddles or saddle trees.

13 Claims, 4 Drawing Sheets

HORSE SADDLE TREE HAVING FABRIC REINFORCED RUBBER BARS

BACKGROUND OF THE INVENTION

1. Field of the Invention

The present invention is related to a saddle that conforms to the shape of a horse's back and flexes to conform to the horse's back as it changes during movement. More particularly, the present invention is directed to a saddle having flexible rubber bars that ride on the horse and support the saddle.

2. Description of Related Art Including Information Disclosed Under 37 C.F.R. Sections 1.97–1.99

Conventionally, horse saddles are made of leather pieces that are laid up on a saddle tree. Saddle trees have conventionally been made of wood covered with stitched rawhide and many still are. Some modern saddle trees are made of fiberglass, which tends to be heavier than wood. Other saddle trees are made of wood covered in layers of fiberglass. In any case, the saddle tree consists of a base, which in turn consists of a pair of bar elements that are spaced apart and rest on the horse's back, with each bar being longer than it is wide and with the longitudinal axis of each bar laid along the horse's back from the front of the horse toward the back of the horse. A fork element is fixed to the bars at a location toward the front of the bars. A horn, usually a separate element, is fixed to the middle of the fork by screws or bolts. A cantle, which forms the back of the saddle tree and later the saddle itself, serves as a sort of back rest to keep the rider from slipping off the rear of the saddle, is fixed to the bars toward the back end of the bars. The fork and cantle are typically fixed to the bars with nails or the like. The saddle tree, or form, is then covered with leather, including a seat cover, ornamentation, cinch strap, stirrups, and so forth.

This type of rigid saddle tree does not actually fit the back of the horse because it is not custom made to the shape and size of any particular horse. Even if it were, the shape of the horse's back changes as it moves, regardless of speed. The hard rigid saddle tree of the prior art does not evenly distribute the weight of the rider and saddle, but rather places that weight on relatively small portions of the horse's back. The conventional saddle tree, in fact, forms a bridge across the horse's back between the withers and scapula toward the front of the horse and the loins, toward the rear of the horse. The effect is basically that the saddle and rider rest primarily on four small points and is not evenly distributed over the horse's back. As the horse moves, the rider and saddle shift back and forth, changing the pressure points on the horse's back. Placement of the weight of the rider and saddle on four small points bridged by a rigid saddle tree restricts the horse's freedom of movement and causes excessive friction at these points as the horse's skin stretches and shrinks as the shape of his body changes during movement. This causes the horse to sore-up, making him irritable and sometimes unridable.

One time-honored attempt to reduce or eliminate this problem is to place a blanket under the saddle, a practice that is still followed today. This modest layer of protection, however, does not always prevent sores on the horse and does nothing to address the problem of uneven pressure on the horse's back.

Another effort to reduce the likelihood of forming sores on a horse's back from the rubbing of the saddle is found in U.S. Pat. No. 5,383,328, which discloses a saddle having a frame underlying the saddle tree frame, with these two elements connected by four screws that can be adjusted to change the distance between the saddle tree and the underlying frame, which is actually in contact with the horse's back. This allows the rider to level the saddle on the horse's back but does not reduce or eliminate high pressure points on the horse's back and does not evenly distribute the weight of the rider and saddle on the horse's back since the lower frame is connected to the saddle tree at only four small points. The horse still suffers from the poor weight distribution and excessive friction of the saddle tree. Therefore, the horse is still likely to become sore from excess pressure and friction. In addition, this saddle burdens the horse with more weight.

Therefore there is a need for a riding saddle trees for a horse that conforms to the back of the horse; that conforms to the back of the horse as the contours of the horse's back change during any type of movement, including, for example, walking, cantering, galloping, running and cutting; that is more comfortable for the rider; that allows a rider to be more stable in the saddle during all types of maneuvers; and that provides the horse with more freedom of movement and better weight distribution.

SUMMARY OF THE INVENTION

Accordingly, it is a primary object of the present invention to provide a riding saddle for a horse that conforms to the back of the horse.

It is another object of the present invention to provide a saddle tree that conforms to the back of the horse as the contours of the horse's back change during movement, including walking, cantering, running and cutting.

It is another object of the present invention to provide a saddle tree that is more comfortable for the rider.

It is another object of the present invention to provide a saddle tree that allows a rider to be more stable in the saddle during all types of maneuvers.

It is another object of the present invention to provide a saddle tree that provides the horse with more freedom of movement and better weight distribution.

These and other objects of the present invention are achieved by providing saddle tree bars that are made of a flexible resilient material. More particularly, the saddle tree of the present invention includes a pair of rubber bars that are composed of alternating layers of fabric and rubber in a pattern designed to provide optimal strength, rigidity and flexibility. Further, the rubber bars are shaped to provide special advantages for both the horse and rider.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE PREFERRED EMBODIMENTS

As required by the Patent Statutes and the case law, the preferred embodiment of the present invention and the best mode currently known to the inventor for carrying out the invention are disclosed in detail herein. The embodiments disclosed herein, however, are merely illustrative of the invention, which may be embodied in various forms. Therefore, specific structural and functional details disclosed herein are not to be interpreted as limiting, but merely to provide the proper basis for the claims and as a representative basis for teaching one skilled in the art to which the invention pertains to make and use the apparatus and process disclosed herein as embodied in any appropriately specific and detailed structure.

Figure 1:
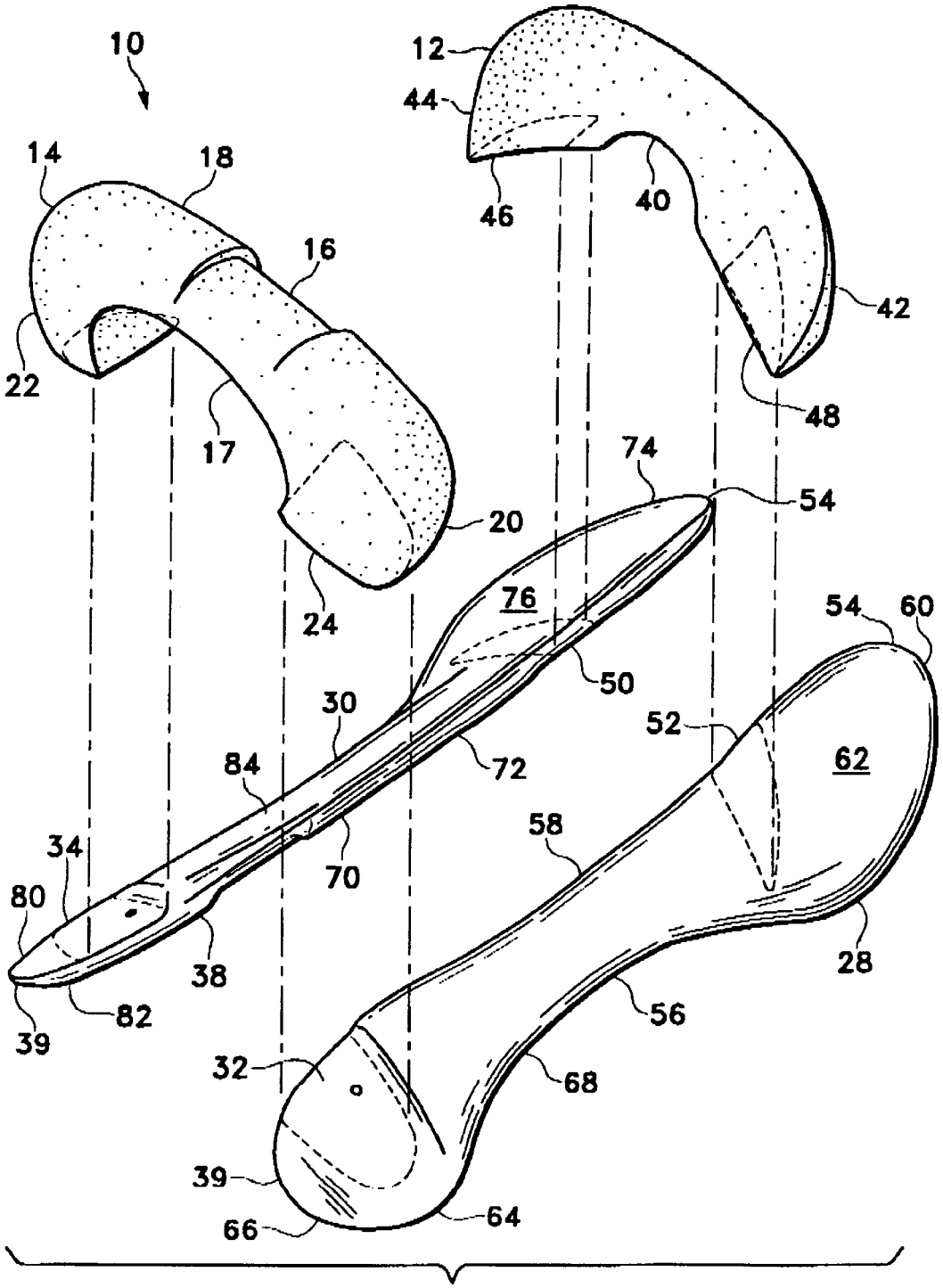
FIG. 1 is an exploded perspective view of the components of a saddle tree made according to the present invention.
Figure 2:
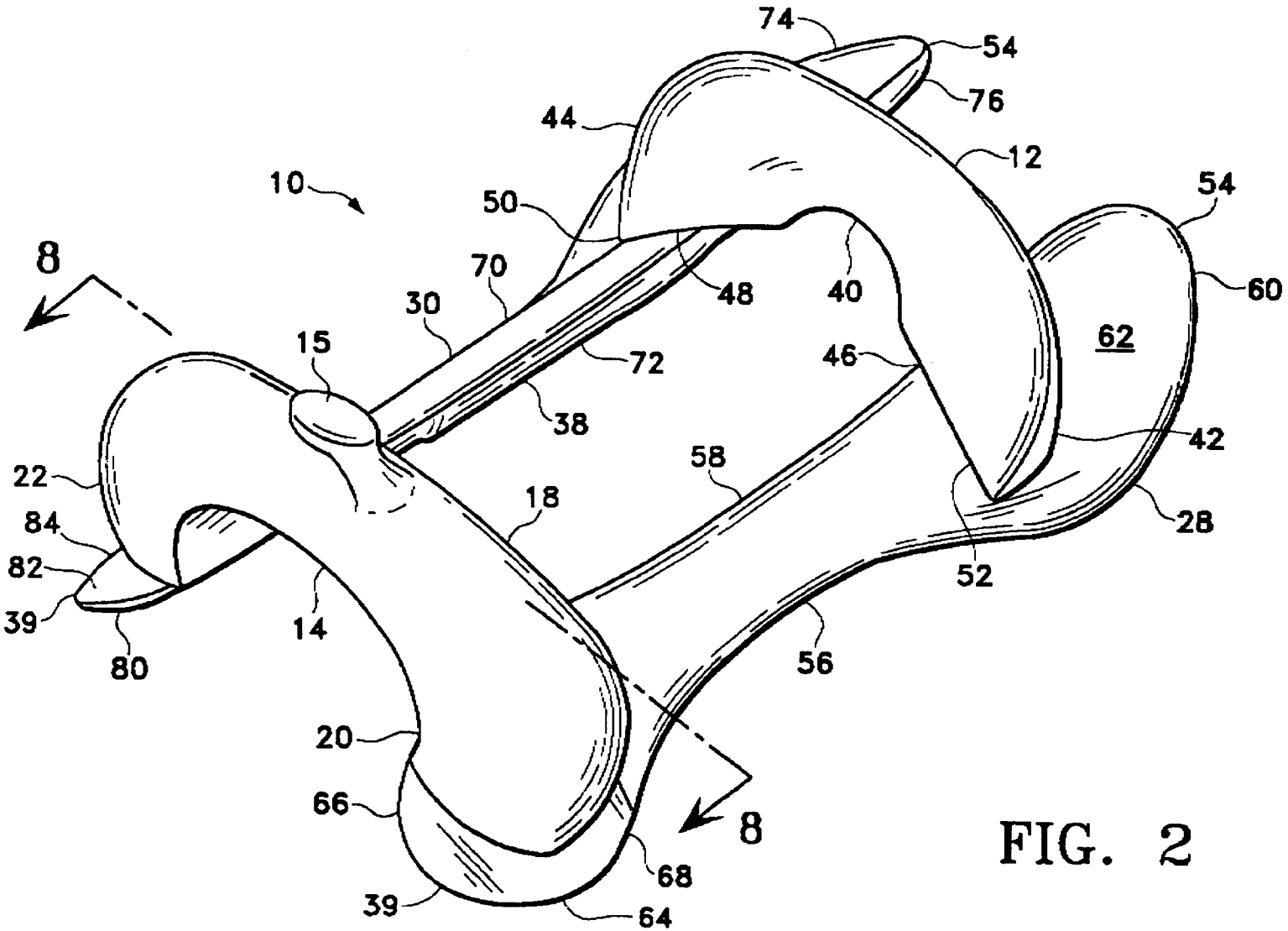
FIG. 2 is a left-hand front perspective view of a saddle tree made according to the present invention.
Figure 8:
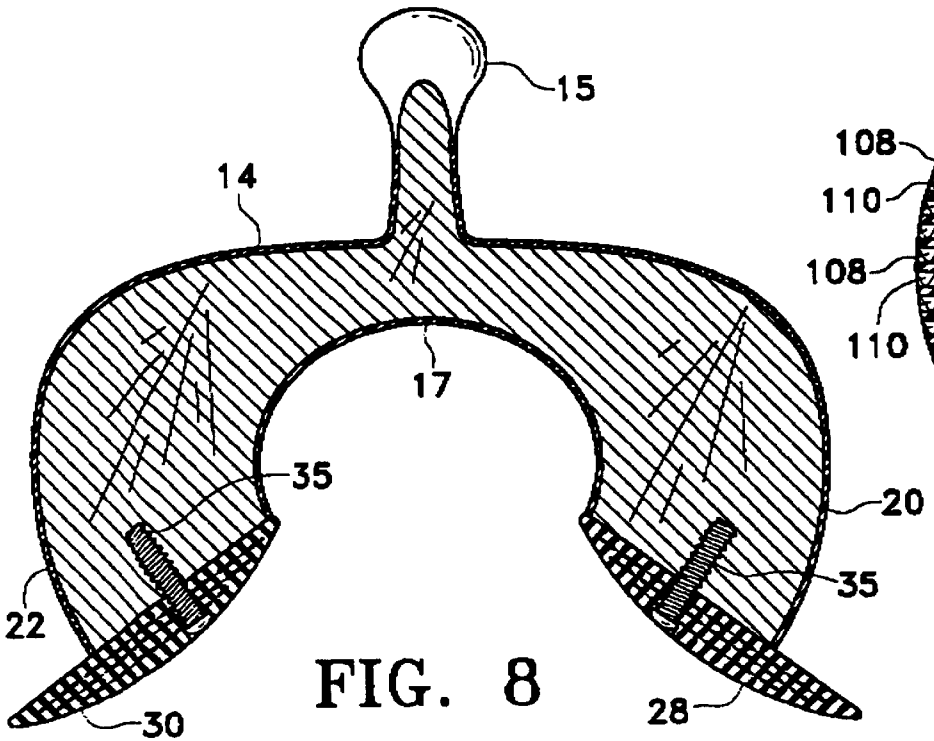
FIG. 8 is a cross section of FIG. 2 taken along lines 8—8 of FIG. 2.

Referring to FIGS. 1 and 2, the horse saddle tree having rubber bars, or rubber bar saddle tree, 10, comprises a cantle 12 and a fork 14, both made of wood or other suitable material, such as fiberglass, wood covered with fiberglass, wood covered with rawhide or other material. The fork 14 includes a flattened upper portion 16 on a top surface 18 of the fork 14 for securing a conventional saddle horn 15 (FIG. 2) by bolting or screwing the saddle horn 15 to the fork or other conventional means and an upthrust central arch portion 17. The fork 14 includes a depending left-hand side arm 20 and a depending right-hand side arm 22, both of which curve downwardly from the top surface 18 and terminate in a left-hand side fork lower mating surface 24, which is flat, and a right-hand fork lower mating surface 26, which is also flat. These fork mating surfaces 24, 26 mate with the mating surfaces of the left-hand bar 28 and the right-hand bar 30, respectively. The fork mating surfaces 24, 26 of the fork 14 are cut off at an angle of about 45° to the horizontal, with normal angles in a range of about 35–75°, so that the bars 28, 30 also lie at about this same angle and fit onto the sloping sides of the horse. The left-hand bar 28 and the right-hand bar 30 are mirror images of each other and hence are not interchangeable. The left-hand bar 28 and the right-hand bar 30 are opposed spaced elements that are substantially parallel to each other and rest directly on the horse's back, except for padding. The left-hand fork receiving surface 32 on the left-hand bar 28 and the right-hand fork receiving surface 34 on the right-hand bar 30 are both flat, so that the fork mating surfaces 24, 26 respectively contact the entire fork receiving surfaces 32, 34. Bolts 35 (See FIG. 8), nails or other mechanical fasteners are used to secure the fork 14 to the bars 28, 30, with the nail heads lying on the lower surfaces of the bars 28, 30. The lower surface of the left-hand bar 28 is designated 36 and the lower surface of the right-hand bar 30 is designated 38. The fork 14 lies adjacent to the front end 39 of the rubber bar saddle tree 10.

Still referring to FIGS. 1 and 2, the cantle 12 includes a central arch portion 40 and a pair of opposing depending arms, including left-hand cantle arm 42 and right-hand cantle arm 44. A right-hand flat cantle mating surface 46 and a left-hand flat cantle mating surface 48 completely contact the respective flat cantle receiving surfaces 50 (right-hand side), 52 (left-hand side) on the bars, including the right-hand bar 30 and the left-hand bar 28, respectively. The cantle 12 is located roughly adjacent to the rear 54 of the rubber bar saddle tree 10 or of the bars 28, 30 and is attached to the bars 28, 30 by bolts, nails or the like, as described in connection with the fork 14 above.

Figure 3:
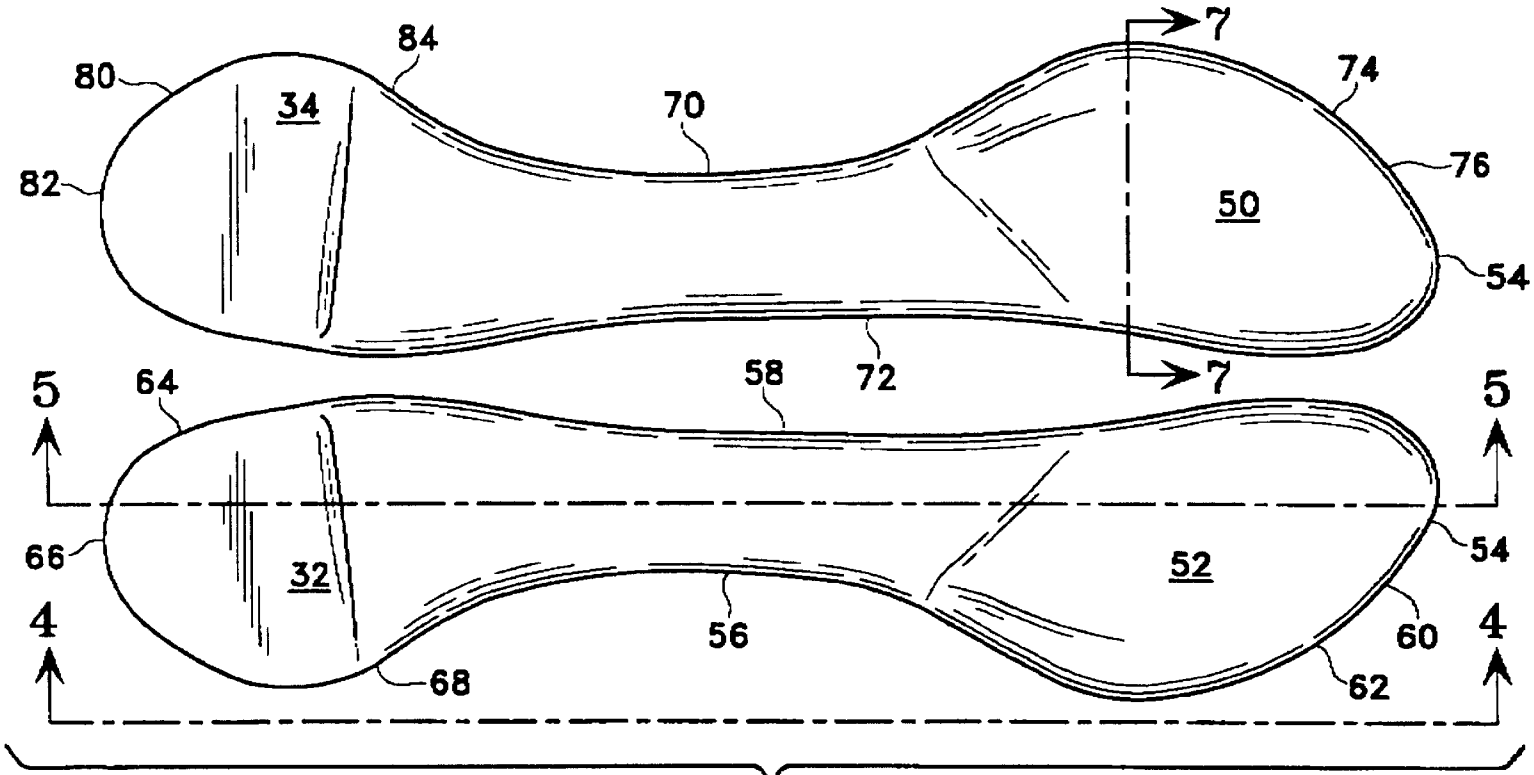
FIG. 3 is a top plan view of the rubber bars of the saddle tree of FIG. 1.

Referring now to FIG. 3, the left-hand bar 28 is an elongated member having a longitudinal axis and a middle portion 56 having a substantially straight inner edge 58 (which is disposed toward the centerline of the saddle or of the horse's back when the rubber bar saddle tree 10 is assembled). A rear portion 60 is wider than the middle portion 56 and defines an asymmetrical paddle shape 62, which includes the left-hand cantle receiving surface 52. A front portion 64 is also wider than the middle portion 56 and has a roughly shoe-sole shape 66 having a centerline that is canted toward the outside edge 68 of the rubber bar saddle tree 10 (that is, toward the horse's sides). The front portion 64 of the left-hand bar 28 includes the left-hand fork receiving surface 32.

Still referring to FIG. 3, the right-hand bar 30 is an elongated member having a longitudinal axis and a middle portion 70 having a substantially straight inner edge 72 (which is disposed toward the centerline of the saddle or of the horse's back when the rubber bar saddle tree 10 is assembled). A rear portion 74 is wider than the middle portion 70 and defines an asymmetrical paddle shape 76, which includes the left-hand cantle receiving surface 50. A front portion 80 is also wider than the middle portion 70 and has a roughly shoe-sole shape 82 having a centerline that is canted toward the outside edge 84 of the rubber bar saddle tree 10 (that is, toward the horse's sides). The front portion 64 of the right-hand bar 30 includes the right-hand fork receiving surface 34.

Figure 4:
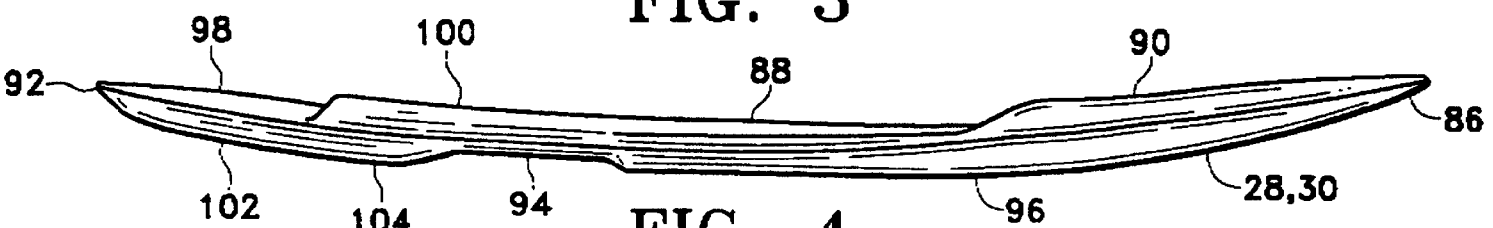
FIG. 4 is a left-hand side elevation of a rubber bar of FIG. 3.
Figure 5:
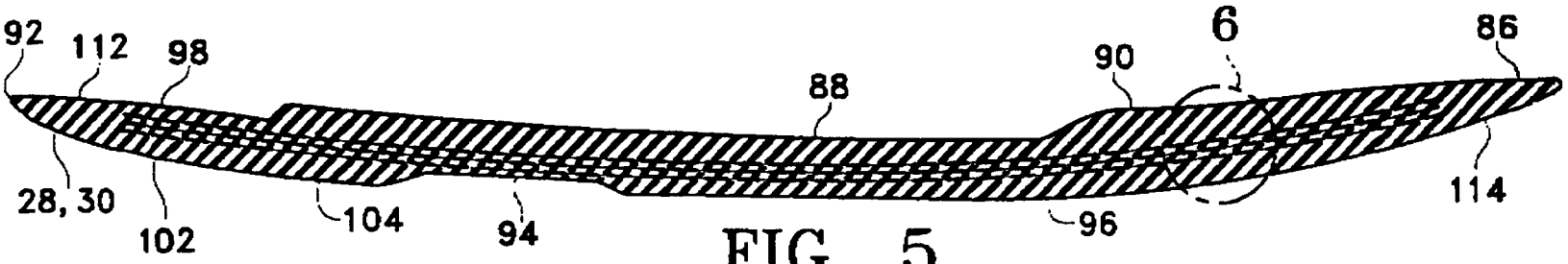
FIG. 5 is a cross section taken along lines 5—5 of FIG. 3.

Referring now to FIGS. 4, 5, which represents a side elevation of both bars 28, 20, the rear end, or portion, 86 is upwardly sloped relative to the middle section 88 and includes an land portion 90 that is higher than the middle section 88. The thickened portion 90 is required to provide a stable platform for the cantle 12. The absence of reinforcing fabric in this are allows greater flexing, while the presence of reinforcing fabric throughout the middle portion 88 reduces flexing and supports weight distribution throughout the entire length of the bars 28, 30. The resulting middle portion 88 is wide enough to distribute weight well, stiff enough to distribute weight almost uniformly throughout the perimeter of the saddle tree 10 and not bend over with the rider, and yet flexible enough to move with and conform to the shape of the horse's back during all types of movement. At the forward end, or portion, 92 of the middle section, or portion, 88 a notch 94 is formed in the lower surface 96 of the middle section 88, which is for receiving stirrup leathers. A front notch 98 is formed in the forward upper surface 100 of the bar 28 or 30 to form the fork receiving surface 50, 52. Forward of the middle section 88 is a thickened area 102, which is necessary for providing additional strength and weight distribution and increased flexing at the forward tips of the bars 28, 30, thereby providing a stable platform for the fork 14. The increased flexing in the thickened area 102 is due to the absence of reinforcing fibers in this area. The reinforcing fibers in the middle portion 88, provide the benefits set out above.

Figure 6:
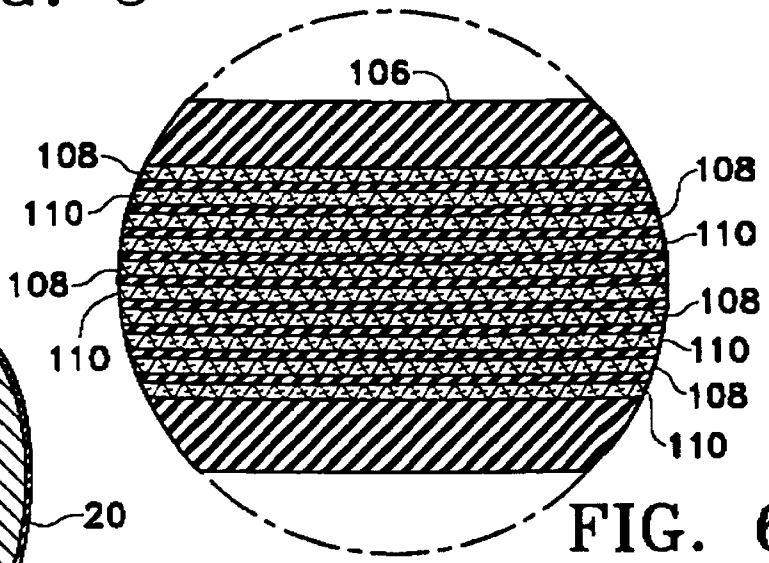
FIG. 6 is an enlarged view of the circled portion of FIG. 5 showing the lamination of the rubber bar of FIG. 3.
Figure 7:
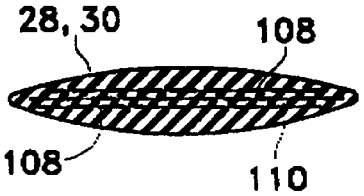
FIG. 7 is a cross section taken along lines 7—7 of FIG. 3.

Referring now to FIGS. 5, 6, and 7, in the preferred embodiment, the bars 28, 30 are made from multi-layered fabric-rubber composite. The bars 28, 30 may be made of any material that is flexible, resilient, that conforms to the contours of the horse's back while the horse is stationary or during any type of movement. Further, the bars must be durable, and resistant to various chemicals, and to moderately extreme changes in temperature. The material must not be susceptible to shrinkage or warping from moisture or water and must be resistant to salt. It has been found that a good material for this purpose is rubber, but even vulcanized rubber is too flexible and weak to withstand the torsion forces placed on a saddle during riding. It has been further found that rubber reinforced with fabric is a suitable material for the bars 28, 30. The flexibility of rubber reinforced fabric is determined by the number of layers of fabric within the rubber body, their thickness, and the spacing between the layers of fabric. In general, the closer the fabric layers are together, the more rigid the final product. It has been found that a composition of rubber with ten equally spaced layers of fabric embedded therein produces bars 28, 30 that exhibit all the desirable characteristics and make the best bars known to the inventor. Preferably, the fabric layers are alternating layers of woven fabric 108 and straight-cord fabric 110 (which has no cross wave cords), as shown best in FIG. 6, which has strength in one direction only (that is, along the cords). The fabric can be cotton, rayon, polyester, nylon, or the like, with the preferred fabric being polyester and it reduces the flexibility of the rubber while reinforcing it. The preferred rubber 106 is a blend of styrene budadine rubber and ethylene propylene monomer (SBR/EPDM Blend). The bars 28, 30 are made by molding.

No conventional test exists to determine the desired flexibility of the bars 28, 30 and none has been devised. The flexibility of they bars 28, 30 changes as they are formed into a rubber bar saddle tree 10 and again as they are built into a saddle. Further, during use a saddle is subjected to at least rotational torque, straight downward torque, inward torque, and numerous straight line forces that make testing regimens very difficult and expensive to devise and carry out. Empirical evidence and testing of models has led to the present preferred embodiment.

The fabric layers run throughout the length of the bar 28, 30, except that the fabric does not extend into the solid rubber front portion 112 or into the solid rubber rear portion 114 of the bar 28, 30, as shown in FIG. 5. This provides for desirable increased flexibility in both the front and rear ends or tips of the bars 28, 30. It is crucial that the rubber bars 28, 30 not be covered with any material that reduces the flexibility of the bars 28, 30, in contrast to conventional saddle tree bars, which are covered in rawhide, fiberglass, or the like that is pulled tight. Such coverings would make the bars 28, 30 too rigid and would eliminate the advantages of the present invention. The bars 28, 30, however, are covered with conventional sheep skins and leather skirts or the like, to pad the bars 28, 30 against the horse's back. A conventional saddle blanket can also be used in connection with a saddle made from the saddle tree 10.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

I claim:

1. A saddle tree comprising:

a. a pair of opposed spaced substantially parallel bars for resting on a horse's back, said bars comprising a flexible resilient material, said flexible resilient material further comprising internal stiffening means, that rests on a horse's back when made into a complete saddle and that conforms to the shape of a horse's back while the horse is stationary or moving, each said bar having a front portion and a rear portion;

b. a fork attached to said front portions of said bars; and c. a cantle attached to said rear portion of said bars.

2. A saddle tree in accordance with claim 1 wherein said flexible resilient material in said bars is rubber.

3. A saddle tree in accordance with claim 1 wherein said stiffening means further comprises multi-layered fabric and rubber composition.

4. A saddle tree in accordance with claim 3 wherein said multi-layered fabric and rubber composition further comprises ten equally spaced layers of fabric embedded in said rubber.

5. A saddle tree in accordance with claim 4 wherein said layer of fabric are further comprised of alternating layers of woven and straight cord fabric.

6. A saddle tree in accordance with claim 3 wherein each said bar further comprises a middle portion, a forward portion and a rear portion and said fabric layers are located in said middle portion of said bars and extend into an adjacent area of said forward portion and of said rear portion.

7. A saddle tree in accordance with claim 1 comprising a front notch in an upper surface of each said bar in each said forward portion of each bar defining a fork arm receiving surface.

8. A saddle tree comprising:

a. a pair of opposed spaced substantially parallel bars for resting on a horse's back, said bars comprising rubber bars made of a blend of styrene budadine rubber and ethylene propylene monomer that rests on a horse's back in when made into a complete saddle and that conforms to the shape of a horse's back while the horse is stationary or moving, each said bar having a front portion and a rear portion;

b. a fork attached to said front portions of said bars;

c. a cantle attached to said rear portion of said bars; and d. means for internal stiffening said rubber bars.

9. A saddle tree in accordance with claim 8 further comprising a multi-layered fabric and rubber composition.

10. A saddle tree in accordance with claim 9 further comprising ten layers of equally spaced fabric in said rubber bars.

11. A saddle tree comprising:

a. a pair of opposed spaced substantially parallel bars for resting on a horse's back, said bars comprising rubber reinforced with at least one layer of fabric wherein said bars rest directly or indirectly on a horse's back when made into a complete saddle and that conforms to the shape of a horse's back while the horse is stationary or moving, each said bar having a front portion and a rear portion;

b. a fork attached to said front portions of said bars; and c. a cantle attached to said rear portion of said bars.

12. A saddle tree in accordance with claim 11 further comprising alternating layers of woven and straight cord fabric embedded in said rubber bars.

13. A saddle tree in accordance with claim 11 wherein said rubber bars further comprise blend of styrene budadine rubber and ethylene propylene monomer.

* * * * *